United States Patent [19]

Heinonen

[11] Patent Number: 4,846,289

[45] Date of Patent: Jul. 11, 1989

[54] ARRANGEMENT FOR SUPPORTING OF AN AXIAL BEARING OF A DRILLING MACHINE

[75] Inventor: Jarmo Heinonen, Tampere, Finland

[73] Assignee: Oy Tampella AB, Tampere, Finland

[21] Appl. No.: 40,944

[22] Filed: Apr. 21, 1987

[30] Foreign Application Priority Data

May 9, 1986 [FI] Finland ..... 861939

[51] Int. Cl.[4] ..... E21B 6/00

[52] U.S. Cl. ..... 173/162.1; 173/105

[58] Field of Search ..... 173/104, 105, 31, 38, 173/162.1

[56] References Cited

U.S. PATENT DOCUMENTS 1,918,065 7/1933 Terry ..... 173/162.1 X 3,858,666 1/1975 Bailey et al. ..... 173/105

FOREIGN PATENT DOCUMENTS 0899902 1/1982 U.S.S.R. ..... 173/104

*Primary Examiner*—Frank T. Yost

*Assistant Examiner*—James L. Wolfe

*Attorney, Agent, or Firm*—Ladas & Parry

[57] ABSTRACT

An arrangement for supporting of an axial bearing of a drilling machine which comprises a body (1) supported by a carriage (15) and a rotation bushing (5) mounting rotatably in the body for rotation of a shank (10). An axial bearing (8) is arranged in the body for receiving axial forces (F) acting on the body through the shank. In order to release the body from strains caused by the axial forces of the shank, the axial bearing is supported on the carriage by a supporting device (16) for transmitting of the axial forces from the axial bearing directly to the carriage.

6 Claims, 2 Drawing Sheets

Figure 3:
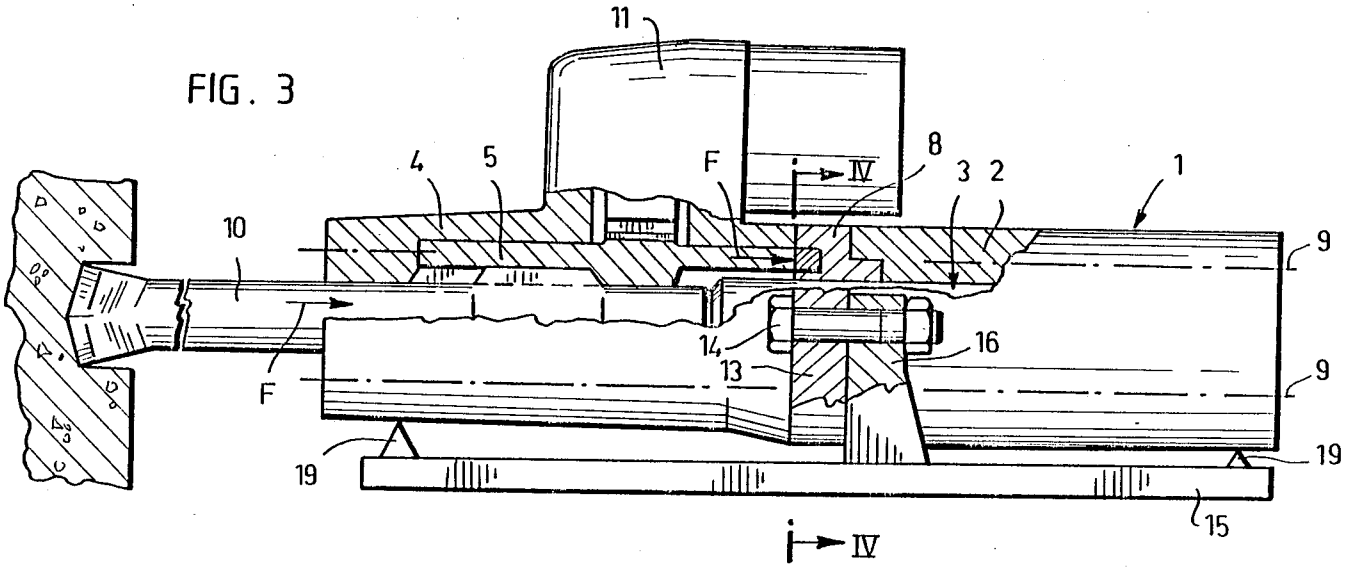

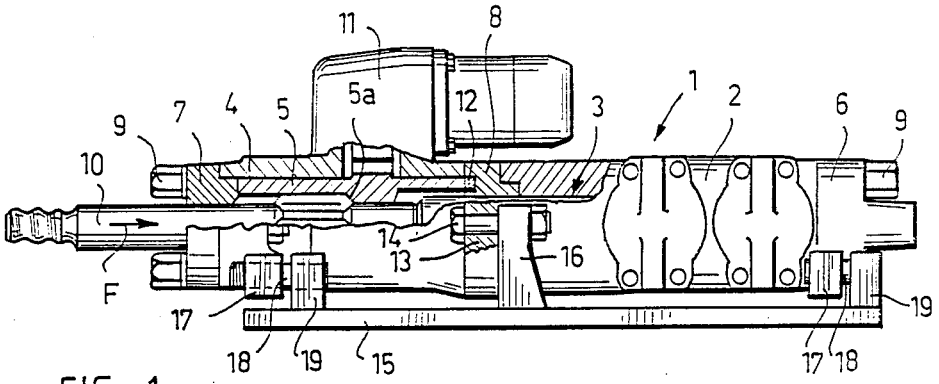
FIG. 1
FIG. 2
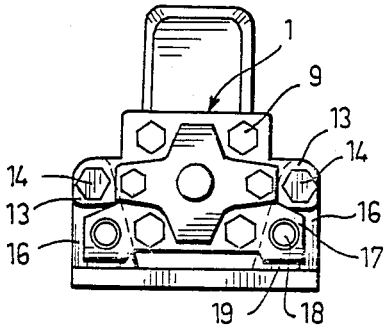
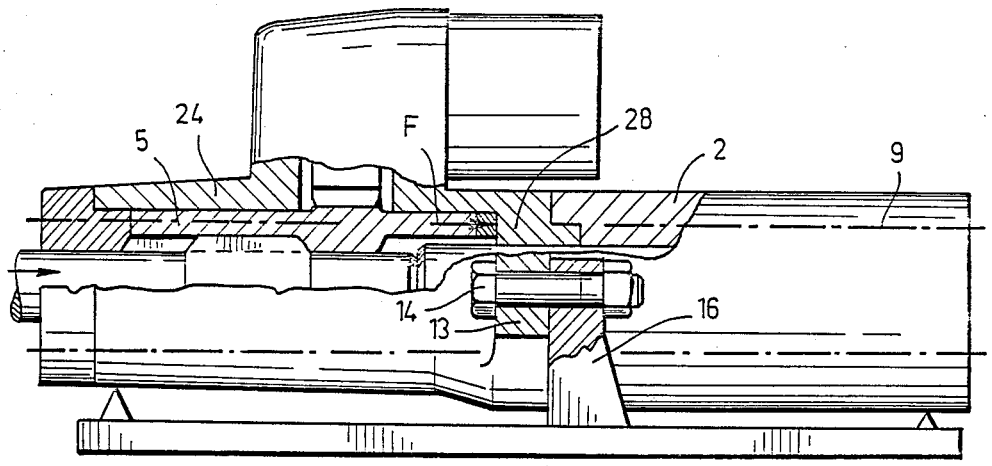
FIG. 5

ARRANGEMENT FOR SUPPORTING OF AN AXIAL BEARING OF A DRILLING MACHINE

This invention relates to an arrangement for supporting of an axial bearing of a drilling machine comprising a body supported by a carriage, a percussion means mounted in the body and a rotation means positioned on an axial extension of the percussion means for rotation of a shank, and an axial bearing arranged in the body for receiving axial forces acting on the body through the shank.

In conventional hydraulic percussion drilling machines, a percussion means mounted in the body is intended to direct successive axial percussions on a shank intended to be fastened to a drill rod. The shank is mounted rotatably and axially slideably in the body by means of a rotation bushing which is in engagement with a rotation machinery supported by the body. The body, in turn, is supported by and fastened to a feeding carriage on which the drilling machine is displaceable along a feeding beam of the drilling equipment.

In rock drilling a percussion impulse is reflected from the rock to the drilling machine, and the reflection force created by the impulse has to be received in some way in the drilling machine. The same applies to the counter force caused by the forward feeding of the drilling machine.

In a known rock drilling machine the feeding force and the forces reflected from the rock are received by means of an axial bearing which is supported by a separate gear housing or by the body and against which the rotation bushing is pressed by the shank during rock drilling. The percussion impulse reflected from the rock passes through the drill rods, the shank and the rotation bushing to the axial bearing and causes vibration. When the body of the drilling machine is assembled of separate body elements which are mounted axially one after another and connected together by means of tie rods, and, further, when the body is fastened to the feeding carriage at the front and rear ends of the body, this vibration is transmitted from the axial bearing to the other elements of the body before the forces causing the vibration are received in the carriage through the front and rear portions of the body. Such a vibration of the body elements exposes the connecting surfaces of the body elements to wear and cavitation and puts the tie rods interconnecting the body elements under a heavy stress.

In another known drilling machine the feeding force and the reflection forces are received by means of a hydraulic system by using a hydraulic piston. A liquid cushion communicating with the hydraulic system of the drilling machine is thereby provided between the body and a special damping piston against which the shank strikes under the influence of the reflection force. However, the powerful high-frequency percussion impulse reflected from the rock strains greatly the seals of the damping piston which are very soon damaged in use. The reflection impulses also cause great pressure variations in the hydraulic system communicating with the piston, and these pressure variations strain with pressure accumulators and interfere with the percussion dynamics of the drilling machine.

The object of this invention is to provide an arrangement which avoids the above disadvantages and by means of which the effects of the reflection impulses, which act on the axial bearing, on the body of the drilling machine can be essentially reduced. This object is achieved by means of an arrangement according to the invention which is characterized in that the axial bearing is supported directly on the carriage by supporting means separate from other support means of the body.

The invention is based on the idea that the axial bearing is supported in such a manner that the feeding and reflection forces acting thereon are transmitted from the axial bearing directly to the feeding carriage so that they are not transmitted through the other elements of the body. Consequently, the feeding and reflection forces do not strain the other body elements or the tie rods, nor do they interfere with the percussion dynamics of the drilling machine. The wear of the connecting surfaces between the body elements is reduced and the tie rods have a longer service life.

Figure 4:
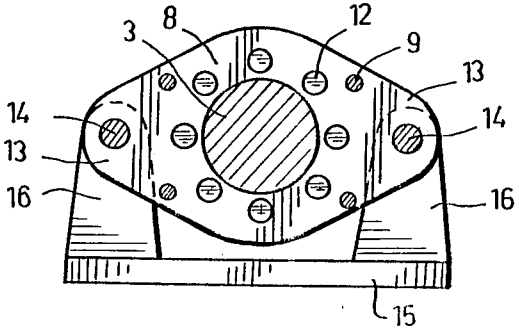

The invention will be described in the following in more detail with reference to the attached drawing, wherein FIG. 1 is a partial axial section of a percussion drilling machine provided with an arrangement according to the invention in a side view, FIG. 2 is a front view of the drilling machine, FIG. 3 is a schematical view of the operating principle of the arrangement shown in FIG. 1, FIG. 4 illustrates an axial bearing in a section along the line VI—VI in FIG. 3, and FIG. 5 illustrates an alternative embodiment of the arrangement similarly as in FIG. 3.

The drilling machine shown in FIGS. 1 and 2 of the drawings comprises a body 1 which is formed by a rear element 2 in which a percussion means 3 is mounted; a front element 4 in which a rotation bushing 5 is mounted coaxially with the percussion means; an end cover 6; and a front cover 7. An axial bearing 8 according to the invention is positioned between the rear and the front element of the body. The axial bearing and the above-mentioned body elements are assembled into a rigid unit by means of longitudinal tie rods 9. A shank 10 is arranged in the rotation bushing axially slideably but unrotatably. The shank is intended to be fastened to a drill rod. The body supports a rotation machinery 11 which is in engagement with the rotation bushing.

In this embodiment the axial bearing is formed by a separate annular piece, the front surface of which is provided with fixed bearing studs 12 which are arranged around the central opening of the axial bearing. The bearing studs are positioned opposite to the rear end of the rotation bushing.

The axial bearing is provided with fastening lugs 13 which are attached by means of bolts 14 to supports 16 fastened to a carriage 15. The supporting surface between the lugs and the supports is positioned in a plane transverse to the axis of the driling machine, so that the supports bear the body and support it in the axial direction. The front and the rear end of the body are further provided with auxiliary lugs 17 which are supported by means of axial supporting pins 18 on auxiliary supports 19 provided in the carriage, so that they support the body in the radial direction.

The axial bearing of the drilling machine operates in the following way:

When the shank is displaced axially inwards within the rotation bushing under the influence of the feeding force and the reflection forces and bears on a shoulder 5*a* of the rotation bushing by means of its cogging, the rear end of the rotation bushing strikes axially against the bearing studs. Since the axial bearing is rigidly supported on the carriage, the feeding and reflection forces F exerted on the axial bearing are passed directly to the carriage from the axial bearing. Consequently, the body elements are not strained by these forces, because the forces are not transmitted through the other body elements to the carriage, but they are received in the carriage solely through the axial bearing 8 and the supports 16 of the carriage.

The embodiment shown in FIG. 5 differs from the preceding one mainly with respect to an axial bearing 28 which is integral with a forward body element 24 and is formed at the rear end thereof. The rear end of the body element is provided with fastening lugs 13 from which the axial bearing formed by the body portion is fastened to the carriage.

The drawings and the description related thereto are only intended to illustrate the idea of the invention. In its details the arrangement according to the invention may vary within the scope of the claims. Accordingly, it is possible to arrange the bearing studs in the rotation bushing as shown in FIG. 5. It is also possible to form the axial bearing in a backward element of the body similarly as in FIG. 5. When a direct driven shank is used, i.e. when the rotation cogging is formed directly on the shank, the cogging of the shank may strike against the axial bearing directly or indirectly.

I claim:

1. An arrangement for supporting an axial bearing of a drilling machine comprising:

a body supported by a carriage by a first supporting means, a percussion means mounted in the body and a rotation means positioned on an axial extension of the percussion means for rotation of a shank, and an axial bearing arranged in the body in an abutting relationship with said rotation means so that the axial forces acting the rotation means through said shank are directly transferred from the rotation means to the axial bearing, and wherein the axial bearing is supported directly on the carriage in the axial direction, by a second supporting means separate from said first supporting means that supports the body radially, so that the axial forces received by the axial bearing are transferred to the carriage.

2. An arrangement according to claim 1, wherein the percussion means and the rotation means are mounted in separate body elements interconnected by means of tie rods, and wherein the axial bearing is formed by a separate part positioned between said body elements and provided with fastening lugs for fastening to the carriage.

3. An arrangement according to claim 2, wherein the carriage is provided with a support on which the fastening projections are supported in the axial direction by means of fastening bolts.

4. An arrangement according to claim 2, wherein the first supporting means is provided at opposite ends of the body between the body and the carriage for radial support of the body.

5. An arrangement according to claim 2, wherein the axial bearing is provided with bearing means positioned in the path of axial movement of a rotation bushing for the shank.

6. An arrangement according to claim 1, wherein the percussion means and the rotation means are mounted in separate body elements interconnected by means of tie rods, and wherein the axial bearing is formed in that end portion of one body element which faces the other body element and that said end portion is provided with fastening lugs for fastening to the carriage.

* * * * *